United States Patent [19]

Uyeda et al.

[11] Patent Number: 4,901,546

[45] Date of Patent: Feb. 20, 1990

[54] RANDOMLY-FALSE-GATED TUMBLER WHEELS FOR COMBINATION LOCKS

[76] Inventors: Tim M. Uyeda, 8317 Elsmore Dr., Rosemead, Calif. 91770; Klaus W. Gartner, 2632 Via Anacapa, Palos Verdes Estates, Calif. 90274; Peter J. Phillips, 828 Calle de Arboles, Redondo Beach, Calif. 90277

[21] Appl. No.: 862,003

[22] Filed: May 12, 1986

[51] Int. Cl.[4] ..... E05B 37/00

[52] U.S. Cl. ..... 70/323; 70/333 R

[58] Field of Search ..... 70/323, 325, 324, 333, 70/291, 286

[56] References Cited

U.S. PATENT DOCUMENTS

| | | |
|---|---|---|
| 8,593 | 12/1851 | Rickards et al. . |
| 176,876 | 5/1876 | Miller . |
| 1,655,840 | 1/1928 | Nichin . |
| 2,016,487 | 10/1935 | Doenges . |
| 2,856,765 | 10/1958 | Sreb . |
| 3,098,376 | 7/1963 | Miller . |
| 3,106,083 | 10/1983 | Manynard . |
| 3,968,667 | 7/1976 | Gartner et al. . |
| 3,983,727 | 10/1976 | Todd . |
| 4,142,388 | 3/1979 | Phillips et al. . |

*Primary Examiner*—Henry E. Raduazo

*Attorney, Agent, or Firm*—Poms, Smith, Lande & Rose

[57] ABSTRACT

The tumbler wheels have a plurality of false gates, each having a width, depth and/or angular position feature which is a random value selected from within given circumferential, radial and/or angular locational limits, respectively, to foil sophisticated sound wave analyzers. Additonally, the wheel may include an outer periphery whose radius between pairs of adjacent gates is randomly variable within given limits. A method and apparatus for producing the random wheels in large batches includes spindling a large number of blank wheels on an arbor and randomly rotating the arbor selectively relative to a cutting tool which is randomly movable selectively in two axes.

11 Claims, 2 Drawing Sheets

RANDOMLY-FALSE-GATED TUMBLER WHEELS FOR COMBINATION LOCKS

BACKGROUND OF THE INVENTION

1. Field of the Invention

This invention relates, in general, to tumbler wheels for combination locks, and in particular, to a tumbler wheel having a plurality of random false gates, and a method and apparatus for making the same.

2. Description of the Related Art

A combination lock typically comprises a rotatable dial on the outside end of a spindle which is coupled through the lock's housing or a safe door to a set of annular tumbler wheels, each provided with a gate in its outer periphery and so interconnected to the other tumblers by dogs and lost-motion couplings that the gates of the tumblers can be aligned with one another by a predetermined series of manipulations of the dial corresponding to the lock's combination. When all of the gates are aligned relative to a fence lever, a fence on the lever drops into the slot formed by the aligned gates to permit a nose on the fence lever to engage a notch in a cam wheel, also coaxially mounted to the lock's spindle, which, upon further rotation of the dial, withdraws the lock's bolt from within a recess to open the lock or door. One such a combination lock is described in U.S. Pat. No. 176,876 to D. K. Miller.

Paralleling the implementation of these locks has been the development by unauthorized persons of means for gaining illicit entry to the contents protected by these locks. Typically, these means include gaining visual access, either directly or radiographically, to the tumbler wheels to ascertain the relative location of their gates, or by means of "touch" or "feel", in which the unauthorized manipulator obtains information about the wheels' gate locations from audible or tactile sensing of the minute vibrations caused by engagement between the cam wheel and nose part, or between the fence lever and the external peripheries of the tumbler wheels, when the dial is manipulated from without the lock.

Over the years, various efforts have been made to defeat the picklock's methods. It is known, for example, to provide the tumbler wheels of a combination lock with a plurality of false gates, each of which has a radiographic image identical or substantially similar to that of the wheels' true gate, such as is disclosed in U.S. Pat. Nos. 3,983,727 to Todd, 2,016,487 to Doenges, or 2,856,765 to Sreb. In another example of this art, U.S. Pat. No. 3,098,376 to Miller, radiographic compromise of the lock is resisted by means of the inclusion of a number of false tumbler wheels situated proximally of the lock's true tumbler wheels.

Similar efforts have been made to deny the picklock information about the wheels' gate location by use of sound or touch. An early example of this is to be found in U.S. Pat. No. 8,593 to Rickards, et al., in which a tumbler wheel of the lock is provided with a series of palpable notches to foil efforts at tactile manipulation by the picklock. In another example, U.S. Pat. No. 1,655,840 to Nichin, the tumbler wheels are provided with a plurality of notches which are caused to ratchet over a rib to set up a clicking noise when the lock's dial is rotated so as to camouflage the sound of the tumbler wheels' engagement with the fence lever. Maynard, in U.S. Pat. No. 3,106,083, discloses a combination lock in which operational parts are made of sound-deadening materials.

In addition to the use of false gates, it is also known to provide mechanisms within a combination lock whose purpose is to retain the fence lever in a position of disengagement from the tumbler wheels and/or cam wheel, except for a single point in one revolution of the lock's spindle, at which point the fence lever is biased into momentary contact with the peripheries of the tumbler wheels and/or the cam wheel. If, at this point in the lock's manipulation, the gates of the tumbler wheels are not in alignment with the fence of the fence lever, subsequent rotation of the dial retracts the fence lever from further contact with the cam or tumbler wheels such that continuous tactile or audible information concerning the gate's location becomes unavailable. Such an apparatus is described in U.S. Pat. No. 3,968,667 to Gartner, et al. These devices, when used in conjunction with tumbler wheels having false gates, render the combination lock highly tamper resistant.

Unfortunately, developments by unauthorized lockpickers have not lagged far behind those whose purpose it is to defeat their efforts at illegal entry. Thus, a method is known by some few, but highly sophisticated, lock breakers to overcome even those combination locks equipped with both fence lever control devices and false-gated tumbler wheels. The equipment employed in this technique is sophisticated and two-fold: first, an apparatus exists which is capable of a very rapid external manipulation of the lock's dial in a predetermined manner which is programmable, and capable of dialing a complete combination for a three-wheel lock at a rate of 10 seconds per combination.

Coupled with this device in the illicit method is the use of a sophisticated sound wave analyzer which is acoustically coupled to the lock during its manipulation. Thus, by a rapid manipulation of the lock's spindle by the dialing apparatus, the fence lever control mechanism can be brought repeatedly into contact with the outer periphery of the tumbler wheels at successive angular positions of the wheels in a kind of "tapping" motion, which is then sensed by the wave analyzer. By having previously procured and analyzed a specimen of the particular lock to be picked, including those having false-gated tumbler wheels, the unauthorized manipulator will already have at hand a sound exemplar for use by the analyzer for comparison purposes to permit it to distinguish between the true and false gates on each tumbler wheel and to predict the accurate location of the true gate in each wheel. The dialing machine can then be programmed to quickly dial all possible permutations of the tumbler wheels which bring these predicted locations in alignment with the fence lever and the lock quickly opened.

SUMMARY OF THE INVENTION

It is, therefore, a primary object of the present invention to provide a tumbler wheel for combination locks which is more tamper resistant to the above-described method of illicit entry.

It is a further object of the present invention to provide a method and apparatus for manufacturing such a tamper-resistant tumbler wheel in a reliable and cost-effective manner on a high-volume basis.

These and other objects and advantages of the present invention are preferably accomplished in the provision of combination locks containing at least one tumbler wheel having an outer periphery, exclusive of the wheel's true gate, which is randomly formed between given radial limits. In a narrower embodiment of the invention, the tumbler wheels are provided with a plurality of false gates, the angular position, width and depth of each of which features is a value randomly selected from within given angular, circumferential and radial limits, respectively. Finally, the tumbler wheel may also be made to include another random feature, namely, the radius of the outer periphery between adjacent false gates, which be formed at radii randomly selected from within given radial limits, to further assist in resisting illicit manipulation.

These objects and other advantages of the present invention will be more readily understood by those skilled in the art from a consideration of the following detailed description of the preferred embodiments, especially when considered in light of the appended drawings, of which the following is a brief description.

DESCRIPTION OF THE PREFERRED EMBODIMENT

Figure 1:
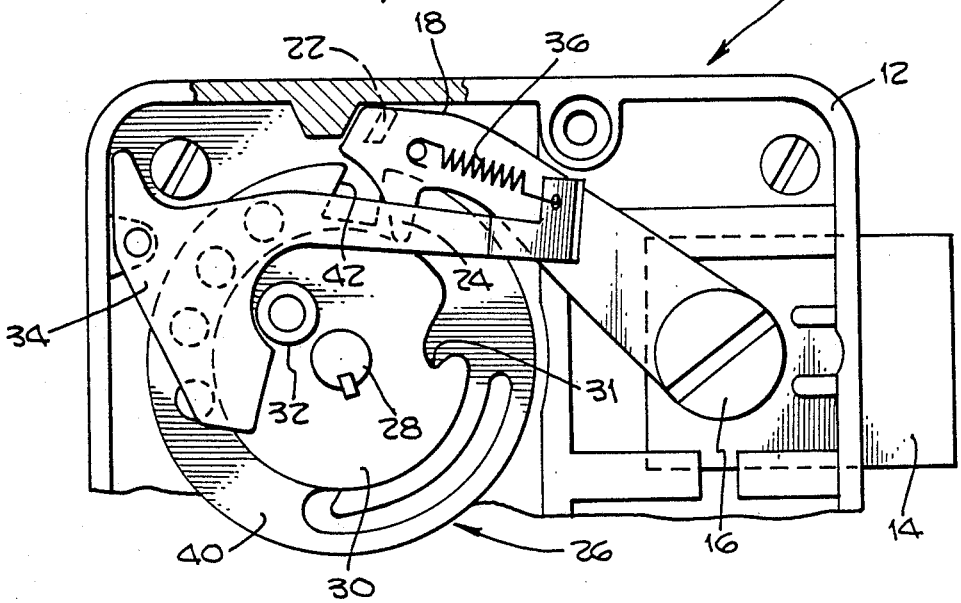
Fig. 1. PRIOR ART
FIG. 1 is a view looking into the rear of a conventional tumbler wheel combination lock.

A tumbler wheel combination lock 10 of conventional construction is illustrated in FIG. 1. Lock 10 includes a housing 12 in which a bolt 14 is slidably retained for movement between locked and unlocked positions. Pivotally attached to bolt 14 at pivot point 16 is a fence lever 18 having a fence member 22 disposed at its distal end and a nose part 24 oriented toward a wheel pack 26.

Wheel pack 26 comprises a spindle 28 rotatably journaled within housing 12, which has mounted at its internal end a cam wheel 30 having a cam wheel gate 31 in its outer periphery disposed to engage nose part 24 of fence lever 18 such that, upon subsequent rotation of spindle 28, fence lever 18 is caused to translate and rotate with cam wheel 30 to withdraw bolt 14.

Wheel pack 26 further includes, in the embodiment illustrated, a follower part 32 attached to cam wheel 30 whose purpose it is to engage a fence lever control mechanism 34 pivotally attached to housing 12. Fence lever control mechanism 34 is, in turn, linked to fence lever 18 by means of spring 36 such that, upon the rotation of spindle 28 through one full revolution, fence member 18 is caused to approach and contact wheel pack 26 once during the revolution and, if a gate-aligned condition is not encountered, to withdraw therefrom upon further rotation of spindle 28.

Wheel pack 26 additionally comprises a plurality of gated tumbler wheels 40 which are rotatably-journaled on spindle 28 through lost-motion couplings and dogs to permit tumbler wheels 40 to be sequentially manipulated in a predetermined fashion by rotations of spindle 28 corresponding to dialing the combination of the lock to align the gates 42 of the wheels below fence member 22. When this combination has been dialed, and upon subsequent rotation of spindle 28, fence lever 18 can be biased toward wheel pack 26 such that nose part 24 engages cam gate 31 to open lock 10.

Figure 2:
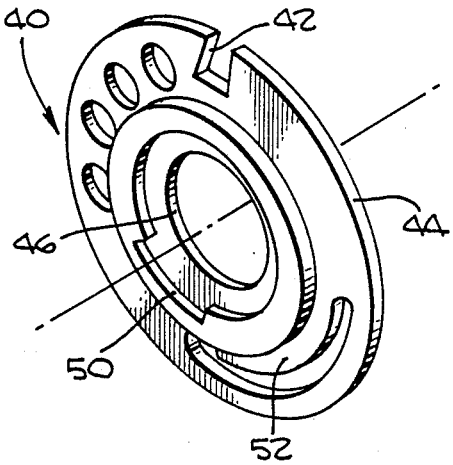
Fig. 2. PRIOR ART
FIG. 2 shows a prior art tumbler wheel.
Figure 3:
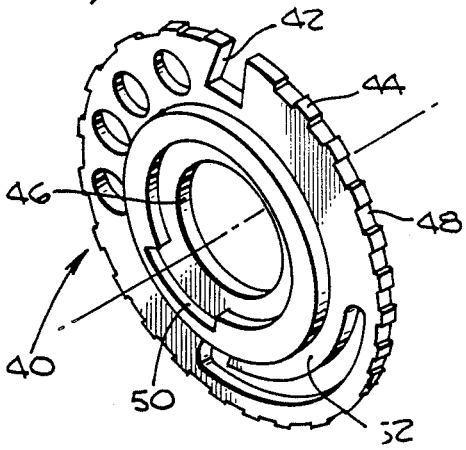
Fig. 3. PRIOR ART
FIG. 3 shows a prior art tumbler wheel having a plurality of false gates on its outer periphery.

A pair of tumbler wheels 40 of the prior art are illustrated isometrically in FIGS. 2 and 3 and comprise an annular shaped disk having an outer periphery 44, an inner diameter 46, a lost-motion coupling feature 50, and may include a connection member 52 to couple tumbler wheel 40 to an inner drive member (not illustrated) in a fashion such that the angular position of the tumbler wheel 40 relative to the drive member, and hence the combination of wheel 40, may be user-adjusted, such as the tumbler wheel disclosed in U.S. Pat. No. 4,142,388 to Phillips, et al.

In addition to containing the a true gate 42, the tumbler wheel 40 of the prior art may also include a plurality of false gates 48 disposed about its outer periphery 44. Typically, false gates 48 are uniform in size and uniform in distribution about outer periphery 44. The outer profile of tumbler wheel 40 is typically produced in its final form by a die-punching operation in which true gate 42, false gates 48 and outer periphery 44 are realized simultaneously.

Those skilled in the art will recognize that, once a picklock has obtained an exemplar of the tumbler wheel 40 of the prior art and has analyzed it with a view towards obtaining the sound "signature" of the wheel, as measured with the sophisticated wave analyzer discussed above, he or she will then have a baseline for comparison and analysis of any other lock of a like make and model. It is to be noted that, because of tolerance considerations, e.g., out-of-roundness, tumbler wheels 40 may differ slightly from one to the other within a given lock such that fence member 22 is likely to impinge only one of the wheels during the downward traverse of fence lever 18, and that this serves as an aid against illicit analysis, since, ordinarily, it will not be known which tumbler wheel is being impacted upon. Nevertheless, with the baseline provided by the exemplar, a sophisticated wave analyzer is able to distinguish not only which wheel 40 in wheel pack 26 upon which fence member 22 is impinging, but also whether fence member 22 is impinging upon the true gate 42, a false gate 48 or the outer periphery 44 of the tumbler wheel such that, in relatively short order, each wheel within the lock can be "charted" to identify the location of true gate 42 with a high degree of probability.

Figure 7:
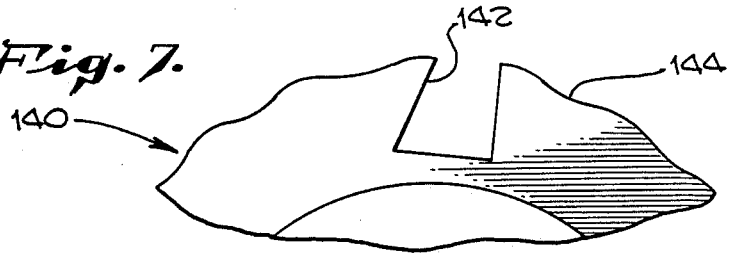
FIG. 7 shows an alternative embodiment of the tumbler wheel made in accordance with the present invention.

It has been discovered that the effectiveness of the wave analyzer can be considerably attenuated, if not eliminated altogether, by the provision within a combination lock of a tumbler wheel having an outer periphery, exclusive of the true gate, randomly formed between given radial limits. An exemplary first preferred embodiment of such a tumbler wheel 140 is illustrated in FIG. 7, with similar features numbered similar to that of the prior art tumbler wheels 40 illustrated in FIGS. 2 and 3, plus 100. In its most general sense, tumbler wheel 140 of the present invention may be thought of as having a infinite number of false gates whose angular position feature relative to true gate 142, and width and depth features into outer periphery 144, are random variables within given dimensional limits. It will be readily understood that, if lock 10 were provided with a plurality of such randomly-formed, false-gated tumbler wheels 140, a would-be picklock who obtained such a lock for disassembly and analysis of one of the wheels would be prevented from using the analysis as a comparison baseline from one wheel to the next, much less from one lock to another, and the sophisticated wave analyzing equipment discussed above is deprived of its baseline by which it can distinguish, on a trial-dialing basis, between wheels, true gates and false gates, etc. It is to be noted that, by provision of the tumbler wheels 140 of the instant invention, lock 10 is not rendered completely resistant to this sophisticated analysis technique. However, the time necessary to "chart" each wheel within a given lock 10 is magnified considerably, and the information provided thereby does not carry over from wheel to wheel or from lock to lock. Thus, the tumbler 140 of the present invention does not render lock 10 "manipulation proof," but rather, it "buys time" for the lock's owner to implement additional security measures.

The first preferred embodiment of tumbler wheel 140 illustrated may be fabricated individually on numerically-controlled milling machines at a fairly rapid rate. Wheel blanks, each die-punched to contain a circular periphery and a true gate, are magazine-fed into the machine and rotated axially relative to a moving cutting tool. Preferably, the depth of cut of the cutting tool can be made to vary randomly within the given radial limits as the part rotates at a constant rate relative thereto. Although the randomly-cut profile 144 of the first preferred embodiment of the tumbler wheel 140 illustrated in FIG. 7 is shown to be relatively "smooth", it need not be necessarily made so, but may include "discontinuities" in outer periphery 144, so long as fence member 22 is not caused to bind with any given wheel or between any pair of wheels within the lock.

Figure 4:
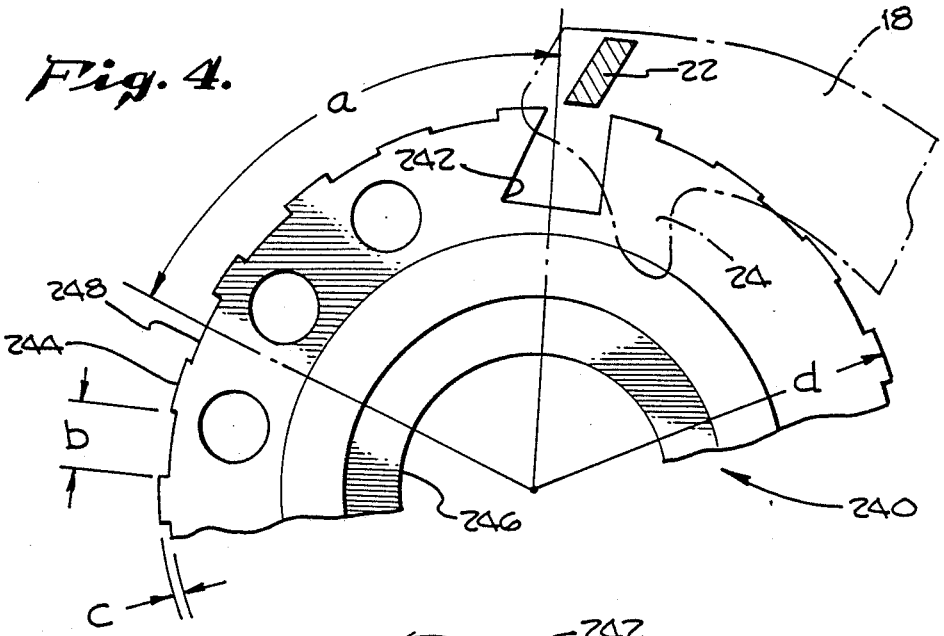
FIG. 4 is a partial plan view of an exemplary tumbler wheel in accordance with the instant invention, shown in conjunction with a fence lever, which is illustrated in phantom lines.

An exemplary second preferred embodiment of a tumbler wheel 240 in keeping with the instant invention is illustrated in FIG. 4, with similar elements numbered similarly to those of the prior art wheel 40 illustrated in FIGS. 2 and 3, plus 200. It will be noted that in the second preferred embodiment, outer periphery 244 of tumbler wheel 240 is cut to contain a plurality of "regular" false gates 248 whose angular position feature upon the wheel relative to some arbitrary index, e.g., true gate 242, and whose width and depth features are all random values selected from within given angular locational, circumferential and radial limits, respectively. These features are best illustrated in FIG. 4, where they are labeled as a, b, and c, respectively. As an additional aid to resistance against sound analysis, the tumbler wheel 240 of the second preferred embodiment may be cut to include yet another randomly selected feature, viz., the radius of the outer periphery 244 of the wheel 240 between adjacent pairs of false gates 248. This fourth randomly-selected feature is labeled as d in FIG. 4.

In the second preferred embodiment illustrated, tumbler wheel 240 is provided with 19 false gates 248, each having a nominal width b of 0.150" which is randomly-variable between 0.140" and 0.160". Their depth c is made randomly-variable from 0.010" to 0.025" in increments of 0.005". Outer periphery 244 between adjacent pairs of false gates 248 takes on a nominal width of 0.124" with a radius d randomly variable within plus 0.0015–0.010" in increments of 0.002". If this second preferred embodiment of tumbler wheel 240 were provided within a lock 10 having 3 such wheels, and assuming a 0.070" wide fence member 22, such as illustrated in FIG. 1, it can be shown that there will be 8,000 possible combinations, were the wheel to be charted, and that, at an assumed rate of 10 seconds per combination dialed, an average trial dialing time of 22 hours would be required to chart the wheel. Moreover, if the thickness of fence member 22 were to be reduced to 0.030", and the true gate 242, false gates 248, and spaces between gates reduced accordingly in width, it can be shown that the number of possible combinations for the wheel increases to 17,576, which, in turn, would produce an average of 48 hours of trial dialing at 10 seconds per combination to chart wheel 240.

It will be recognized that the wheel 240 of the second embodiment illustrated can be produced most cost effectively when a large batch of wheels can be cut simultaneously. An apparatus and method for accomplishing this is illustrated in FIGS. 5 and 6.

Figure 5:
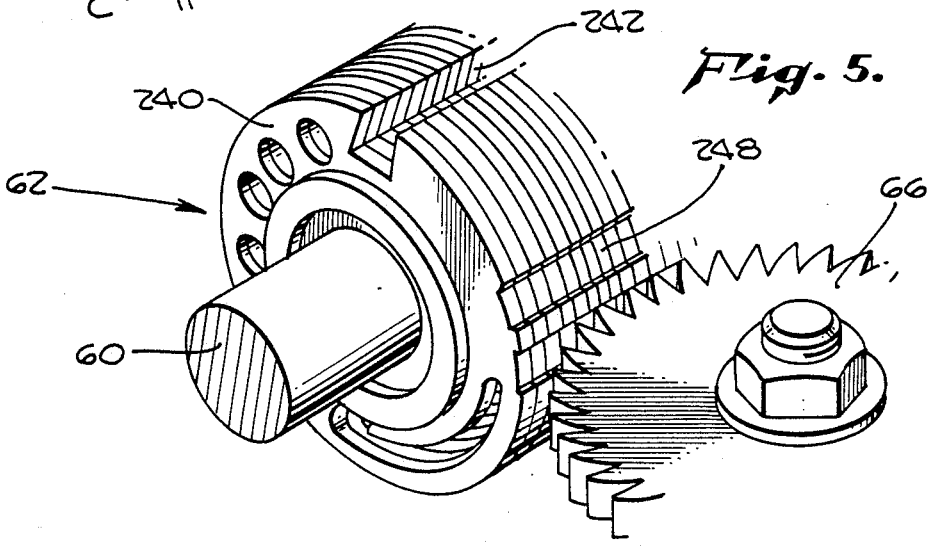
FIG. 5 is a perspective view of the tumbler wheels of the instant invention being fabricated in accordance with the method of the present invention.
Figure 6:
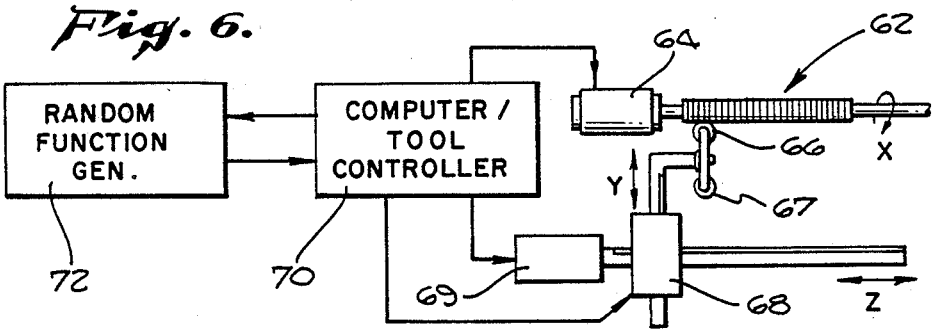
FIG. 6 is a schematic illustration of the apparatus utilized for generating the tumbler wheels of the instant invention.

In the preferred method, a batch of blank wheels, each having a true gate 242 already punched therein, is assembled onto an arbor 60, such as is illustrated in FIG. 5, and clamped together axially to each other and to arbor 60 in a gate-aligned relationship to form a rigid assembly 62. Arbor assembly 62 is then installed into a programmable gate-cutting apparatus such as is illustrated schematically in FIG. 6.

The preferred cutting apparatus includes means 64 for rotating arbor assembly 62 axially in programmable angular steps, e.g., a stepping motor, relative to one or more cutting tools 66 and 67, which are movable both radially and axially relative to arbor assembly 62 by means of tool feeders 68 and 69. A computer/controller 70 is programmable to control automatically the feed rates and depths of stepping motor 64 and tool feeders 68 and 69 such that the angular position X, radial position Y and axial or longitudinally position Z of cutting tool 66 relative to arbor assembly 62 is programmably controllable. A random function generator 72 inputs computer/controller 70 with a random value upon demand such that the angular position a and depth c of the first, and each successive false gate 248 being cut into arbor assembly 62, can be adjusted by control of stepping motor 64 and tool feeder 68 in the X and Y directions, respectively.

The width a of any false gate 248 being cut may be cut in one of two ways, depending upon the method desired. In some apparatus, a plurality of cutting tools 66 may be provided having a plurality of cutting widths within the given circumferential range of false-gate widths selected. In this alternative embodiment, computer/controller 70 will select a cutting tool 66 randomly from the group of cutting tools in accordance with a protocol determined by the value provided it by random function generator 72. This cutting tool is then positioned at one end of arbor assembly 62 by tool feeder 69 at the angular cutting position a and depth b and moved longitudinally down the length of arbor assembly 62 to generate a false gate 242 simultaneously in the entire assembly.

It may be desirable to generate the width feature b of false gate 248 in an alternative manner, particularly if it is not practical or desirable to provide a plurality of false-gate cutting tools 66 of a variety of widths. In this case, false gate 248 may be generated in two or more passes of cutting tool 66 down the length of arbor assembly 62 with a cutting tool 66 having a width slightly less than the width of the smallest false gate 248 desired to be cut, in which arbor assembly 62 is indexed rotationally by stepping motor 64 between cuts until the final random width a of the false gate 248 being cut is achieved.

The radius feature d of the outer periphery 244 between adjacent pairs of false gates 248 may be cut in a similar fashion on a random basis, preferably in a single pass of a periphery-cutting tool 67 down the length of arbor assembly 62, substantially in accordance with the preferred method and apparatus described above.

It will be understood that the batch of false-gated tumbler wheels produced in accordance with the apparatus and method described above, although "random" in the distribution and disposition of false gates 248 cut therein, will be substantially similar to one another within a given batch. However, it is also to be further understood that these batches will subsequently be disassembled from arbor 60 and placed into large tumbling bins for deburring purposes. If a sufficient number of batches are tumbled together, then selected randomly from the bins for assembly onto wheel packs, the random nature of the wheels within any given lock is restored such that even the manufacturer of the lock will not know the true composition of any given lock.

By now, skilled practitioners will recognize that other modifications, methods and apparatus for producing the tumbler wheels of the present invention are possible, depending upon the particular application at hand. Accordingly, the particular embodiments, methods and apparatus discussed and illustrated herein should be taken as exemplary in nature only, and the scope and spirit of the instant application should be limited only by the claims appended hereto.

I claim:

1. An improved tumbler wheel for combination locks, wherein the improvement comprises:

said wheel having at least a portion of its outer periphery, exclusive of its true gate, randomly formed between given radial limits.

2. The wheel of claim 1, wherein:

said portion contains at least one false gate having a width, depth and angular location, at least one of which features is randomly selected from within given circumferential, first radial and/or angular locational limits, respectively.

3. The wheel of claim 2, wherein:

the radius of said periphery between at least one pair of said gates is randomly selected from within given second radial limits.

4. An improved tumbler wheel combination lock, wherein the improvement comprises:

said lock containing at least one tumbler wheel having at least a portion of its outer periphery, exclusive of its true gate, randomly formed between given radial limits.

5. The lock of claim 4, wherein:

said portion contains at least one false gate having a width, depth and angular location, at least one of which features is randomly selected from given circumferential, first radial and/or angular locational limits, respectively.

6. The lock of claim 5, wherein:

the radius of said periphery between at least one pair of said gates is randomly selected from within given second radial limits.

7. In a combination lock having two or more tumbler wheels mounted within the lock for rotational manipulation for opening the lock, wherein each tumbler wheel includes at least one true gate for cooperation with a lever means for opening the lock, the improvement comprising:

each of said tumbler wheels having a plurality of randomly formed false gates randomly located in the periphery of said wheels, wherein the dimensions and locations of said false gates are each predetermined by a first random selection process; and said two or more tumbler wheels have been selected by a second random selection process for inclusion in the combination lock whereby the combination lock incorporating said tumbler wheels has a substantially unique acoustical and tactile detection signature.

8. The invention of claim 7 wherein said first random selection process includes random function generation.

9. The invention of claim 7 wherein said second random selection process includes selecting each of said two or more tumbler wheels from a batch of said tumbler wheels, each having said randomly formed and located false gates therein.

10. The invention of claim 7 wherein said false gate dimensions include a gate depth and a gate width, and wherein said false gate locations include an angular gate location; and wherein each of said false gate dimensions and locations is different from the true gate dimension and location.

11. The invention of claim 10 wherein said false gate dimensions of one or more of said tumbler wheels further include a radial position relative to the center of said tumbler wheel.

* * * * *